US011286721B2

(12) United States Patent
Hepburn et al.

(10) Patent No.: US 11,286,721 B2
(45) Date of Patent: Mar. 29, 2022

(54) COMBINED MULTILATERAL WINDOW AND DEFLECTOR AND JUNCTION SYSTEM

(71) Applicant: Halliburton Energy Services, Inc., Houston, TX (US)

(72) Inventors: Neil Hepburn, Newcastle-Upon-Tyne (GB); Stuart Alexander Telfer, Stonehaven (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/695,559

(22) Filed: Nov. 26, 2019

(65) Prior Publication Data

US 2020/0173238 A1 Jun. 4, 2020

Related U.S. Application Data

(60) Provisional application No. 62/772,679, filed on Nov. 29, 2018.

(51) Int. Cl.

| | |
|---|---|
| ***E21B 7/06*** | (2006.01) |
| ***E21B 34/06*** | (2006.01) |
| ***E21B 29/06*** | (2006.01) |
| ***E21B 17/00*** | (2006.01) |
| ***E21B 41/00*** | (2006.01) |

(52) U.S. Cl.

CPC ..... *E21B 7/061* (2013.01); *E21B 17/006* (2013.01); *E21B 29/06* (2013.01); *E21B 34/06* (2013.01); *E21B 41/0035* (2013.01); *E21B 41/0042* (2013.01); *E21B 2200/05* (2020.05)

(58) Field of Classification Search

CPC ..... E21B 17/006; E21B 7/061; E21B 29/06; E21B 34/06; E21B 41/0035; E21B 2200/05; E21B 41/0042

See application file for complete search history.

(56) References Cited

U.S. PATENT DOCUMENTS

| | | | | |
|---|---|---|---|---|
| 5,564,503 | A * | 10/1996 | Longbottom | E21B 41/0042 166/313 |
| 6,047,774 | A * | 4/2000 | Allen | E21B 7/061 166/313 |
| 6,206,111 | B1 * | 3/2001 | Nistor | E21B 17/00 175/61 |
| 6,585,040 | B2 * | 7/2003 | Hanton | E21B 7/061 166/117 |
| 7,070,000 | B2 * | 7/2006 | Smith | E21B 41/0042 166/117.6 |
| 8,091,246 | B2 * | 1/2012 | Hepburn | E21B 47/024 33/301 |
| 8,789,580 | B2 | 7/2014 | Dancer et al. | |

(Continued)

FOREIGN PATENT DOCUMENTS

| | | | |
|---|---|---|---|
| CN | 103097644 | A | 5/2013 |
| EA | 201491515 | A1 | 4/2015 |

(Continued)

*Primary Examiner* — Nicole Coy

(74) *Attorney, Agent, or Firm* — Scott Richardson; Parker Justiss, P.C.

(57) ABSTRACT

Provided, in one aspect, is a windowed deflector assembly. The windowed deflector assembly according to this aspect includes a tubular housing, the tubular housing having a window there through, a wrap covering the window, and a deflector coupled to or formed integrally as part of the tubular housing.

16 Claims, 11 Drawing Sheets

(56) References Cited

U.S. PATENT DOCUMENTS

| | | | | |
|---|---|---|---|---|
| 2002/0074120 | A1 | 6/2002 | Scott | |
| 2011/0203851 | A1 | 8/2011 | Tinker et al. | |
| 2016/0145956 | A1* | 5/2016 | Dahl | E21B 29/06 166/382 |
| 2016/0230488 | A1 | 8/2016 | Coats | |
| 2018/0274300 | A1 | 9/2018 | Vemuri et al. | |
| 2018/0274317 | A1 | 9/2018 | Hall | |
| 2020/0362656 | A1* | 11/2020 | Fripp | E21B 7/061 |

FOREIGN PATENT DOCUMENTS

| | | | |
|---|---|---|---|
| RU | 2313651 | C1 | 12/2007 |
| WO | 2020032934 | A1 | 2/2020 |

* cited by examiner

COMBINED MULTILATERAL WINDOW AND DEFLECTOR AND JUNCTION SYSTEM

CROSS-REFERENCE TO RELATED APPLICATION

This application claims the benefit of U.S. Provisional Application Ser. No. 62/772,679, filed on Nov. 29, 2018, and entitled "COMBINED MULTILATERAL WINDOW AND DEFLECTOR AND JUNCTION SYSTEM," commonly assigned with this application and incorporated herein by reference in its entirety.

BACKGROUND

Hydrocarbons can be produced through relatively complex wellbores traversing a subterranean formation. Some wellbores can include multilateral wellbores that include one or more lateral wellbores extending from a main wellbore. A lateral wellbore is a wellbore that is diverted from the main wellbore from a first general direction to a second general direction.

A multilateral wellbore can include one or more windows or casing exits to allow corresponding lateral wellbores to be formed. The window or casing exit for a multilateral wellbore can be formed by positioning a windowed deflector assembly in a casing string with a running tool at a desired location in the main wellbore. The windowed deflector assembly may be used to deflect a window mill relative to the casing string. The deflected window mill penetrates part of the casing joint to form the window or casing exit in the casing string and is then withdrawn from the wellbore. Drill assemblies can be subsequently inserted through the casing exit in order to cut the lateral wellbore. However, this increases the number of trips required downhole into the wellbore to complete the well.

BRIEF DESCRIPTION

Reference is now made to the following descriptions taken in conjunction with the accompanying drawings, in which.

DETAILED DESCRIPTION

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers a direction that is towards the surface of the well, while the term "downhole" refers a direction that is away from the surface of the well.

The present disclosure provides a windowed deflector assembly that includes a pre-formed window that can be sent downhole with a casing string positioned in the main wellbore, reducing the total number of trips that must be made downhole to complete the wellbore.

Figure 1:
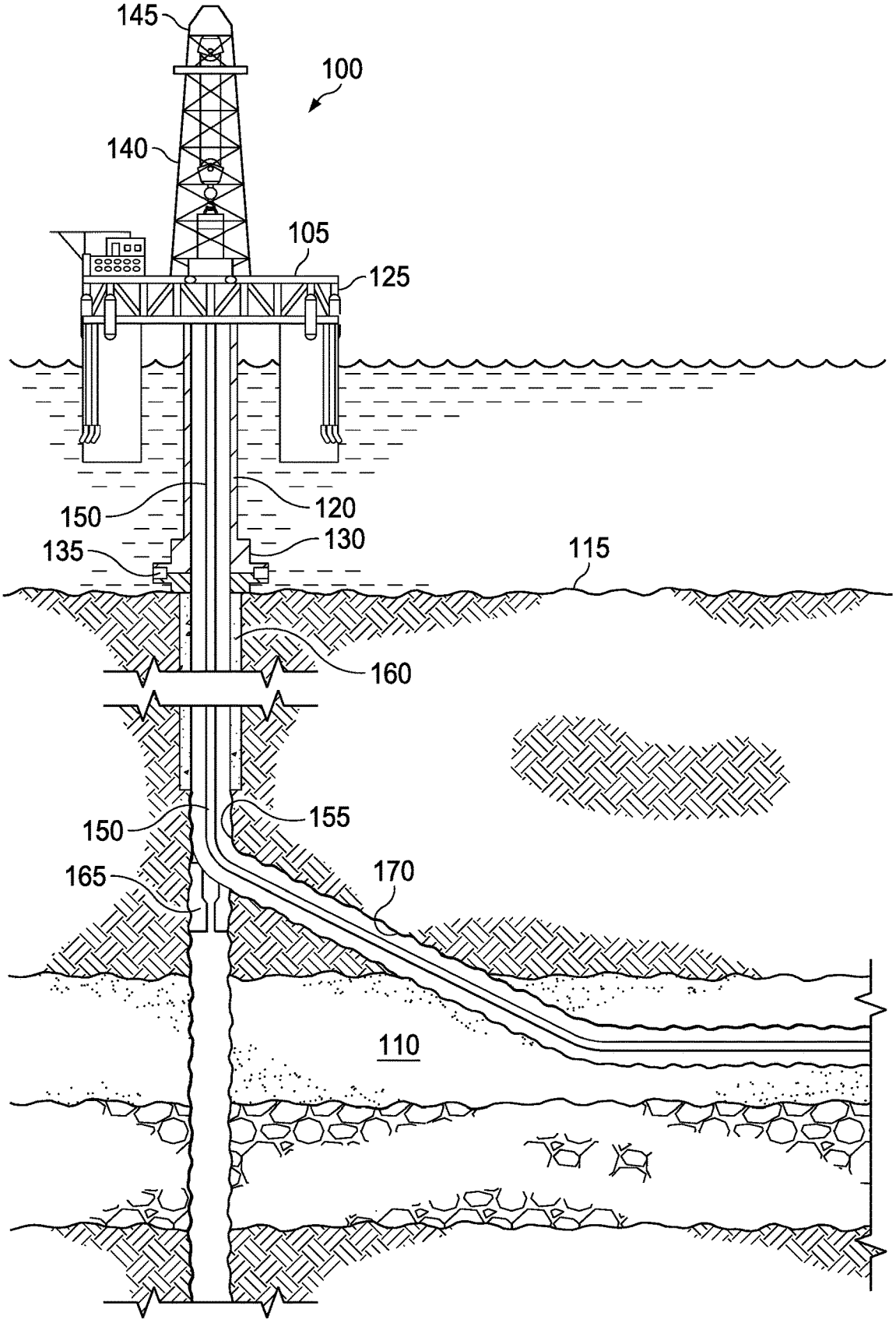
FIG. 1 is a schematic view of an offshore well system, according to one or more embodiments disclosed herein.

FIG. 1 is a schematic view of an offshore well system 100, according to one or more embodiments disclosed. The offshore well system 100 includes a platform 105, which may be a semi-submersible platform, positioned over a submerged oil and gas subterranean formation 110 located below the sea floor 115. A subsea conduit 120 extends from the deck 125 of the platform 105 to a wellhead installation 130 including one or more blowout preventers 135. The platform 105 has a hoisting apparatus 140 and a derrick 145 for raising and lowering pipe strings, such as a drill string 150. Although an offshore oil and gas platform 105 is illustrated in FIG. 1, the scope of this disclosure is not thereby limited. The teachings of this disclosure may also be applied to other offshore wells or land-based wells.

As shown, a main wellbore 155 has been drilled through the various earth strata, including the subterranean formation 110. The term "main" wellbore is used herein to designate a wellbore from which another wellbore is drilled. It is to be noted, however, that a main wellbore does not necessarily extend directly to the earth's surface, but could instead be a branch of yet another wellbore. A casing string 160 may be at least partially cemented within the main wellbore 155. The term "casing" is used herein to designate a tubular string used to line a wellbore. Casing may actually be of the type known to those skilled in the art as "liner" and may be made of any material, such as steel or composite material and may be segmented or continuous, such as coiled tubing.

A windowed deflector assembly 165 according to the present disclosure may be positioned at a desired intersection between the main wellbore 155 and a lateral wellbore 170. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

Figure 2:
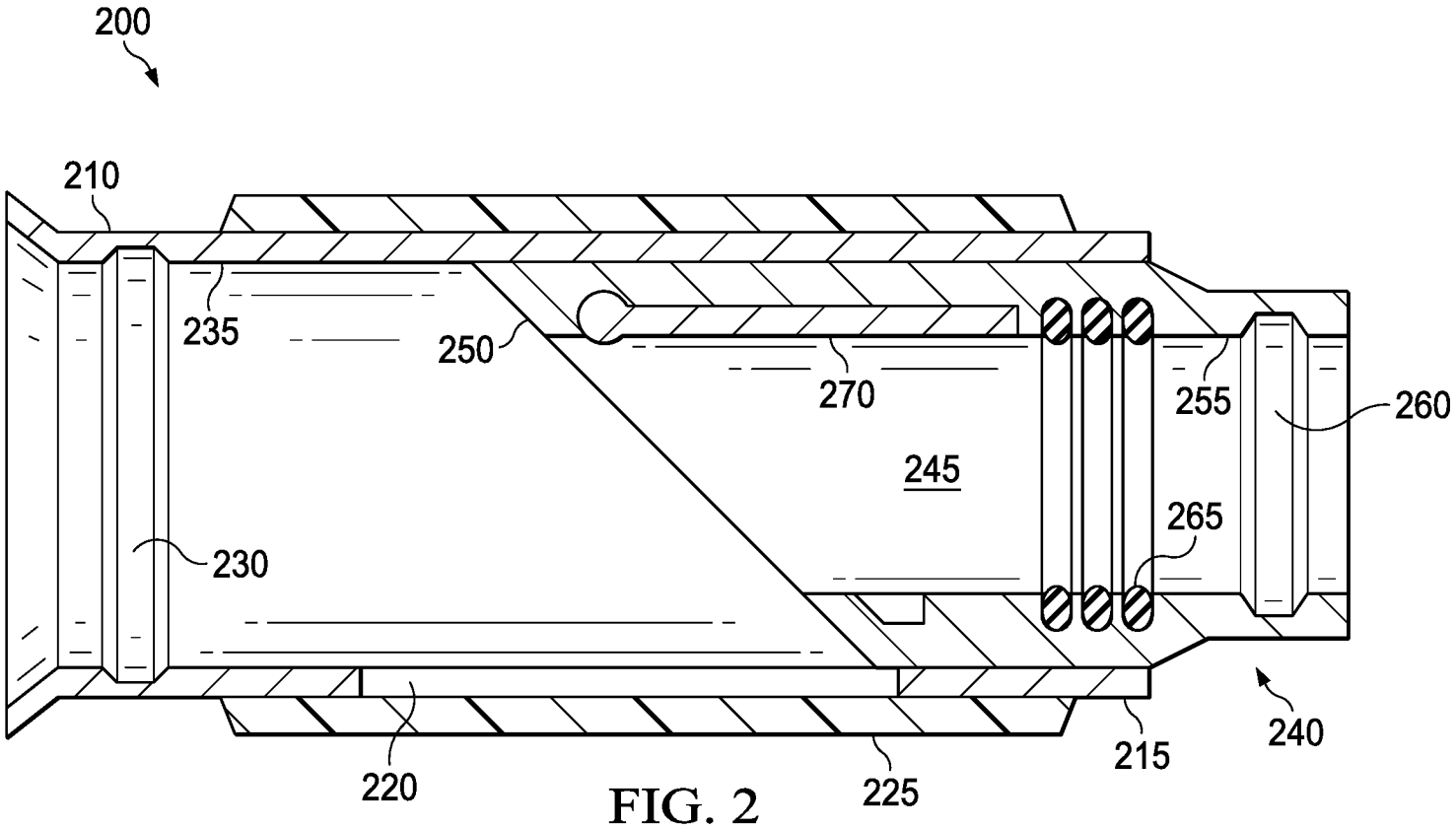
FIG. 2 illustrates one embodiment of a windowed deflector assembly according to the disclosure.

FIG. 2 is a cross-sectional view of a windowed deflector assembly 200 according to one or more embodiments. The windowed deflector assembly 200 may be used in place of the windowed deflector assembly 165 shown in FIG. 1. As shown in FIG. 2, the windowed deflector assembly 200 includes a tubular housing 210. The tubular housing 210 may comprise a variety of different materials and remain within the scope of the disclosure. In one embodiment, however, the tubular housing comprises a high yield strength material such as steel.

A wall 215 of the tubular housing 210 includes a window 220 therethrough to allow a drilling assembly (not show) to pass through the wall 215 with reduced resistance. The window 220, in one embodiment, does not extend entirely around the tubular housing 210, and in one embodiment is in fact just located directly opposing an angled surface of the deflector (see below). The size of the window 220 may, in certain embodiments, be just slightly larger than a drilling tool that will ultimately extend there through.

In some embodiments, a wrap 225 surrounds the tubular housing 210 along the wall 215 that includes the window 220, for example to prevent debris from entering the windowed deflector assembly 200 through the window 220 during deployment. The wrap 225 would have the additional benefit of preventing ingress of drilled cuttings or debris, which could potentially impede the release of the running tool and also to enable for easy orientation of the assembly at depth in the well (e.g., no edges to catch). The wrap 225 may extend entirely around the tubular housing 210 covering the window 220, and thus form a tubular wrap, or alternatively be located covering the window 220 but not extending entirely around the tubular housing 210.

The wrap 225 may be made of a material that allows the window 220 to be opened with a conventional drill bit, removing the need for a specialized milling operation to be conducted prior to drilling a lateral wellbore through the window 220. For instance, any material that would not require a milling bit to get through should be adequate for use as the wrap 225. Additionally, the wrap 225 could comprise any material that easily drillable and low density, such that it can be easily circulated out of the wellbore with drilling fluid. In other embodiments, the wrap 225 might comprise a material that may be drilled without damaging the deflector (see below).

Given the foregoing, in certain embodiments, the tubular housing 210 would comprise a material having a first yield strength, and the wrap 225 would comprise a material having a second lesser yield strength. For instance, if the tubular housing 210 were to comprise steel, it might have a yield strength between about 110 ksi and about 125 ksi. In this embodiment, the wrap 225 might have a yield strength of 100 ksi or less. In certain embodiments, the wrap 225 might have a yield strength of 70 ksi or less, or alternatively a yield strength ranging from about 30 ksi to about 80 ksi. In certain other embodiments, the wrap 225 might comprise a material having a yield strength of 30 ksi or less, and in certain other embodiments having a yield strength of 10 ksi or less. For example, the wrap 225 might comprise reinforced plastic, fiberglass, a composite, carbon fiber, or another similar non-metallic material. In another embodiment, the wrap 225 might comprise a non-ferromagnetic metal, which would have certain retrieval benefits downhole. For instance, the wrap 225 might comprise a thin layer of aluminum, or a thin layer of an aluminum alloy. In one example, the wrap 225 might comprise an 1100 series or 2000 series aluminum alloy having a yield strength ranging from about 5 ksi to about 18 ksi.

The tubular housing 210 may also include an uphole locking profile 230 in an interior surface 235 of the tubular housing 210. As described in more detail below, the uphole locking profile 230 receives a latch coupling of a running tool (not shown). The uphole locking profile 230 also provides a rotational and axial lock for the running tool in the upper end of the windowed deflector assembly 200 to prevent the window joint from be exposed to torque transmission across it, which would likely deform the window 220.

A deflector 240 is coupled to or formed integrally as part of the tubular housing 210, as shown in FIG. 2. Accordingly, the deflector 240 and tubular housing 210 having the window 220 are configured to be deployed in a single run. The deflector 240 includes a cavity 245 that extends through the axial length thereof, and an angled surface 250 that is shaped to direct objects toward the window 220. The angled surface 250, in this embodiment, is integral to the windowed deflector assembly 200 and does not require a deflection device to be installed at a later operational stage for either casing exit creation or junction completion. This also allows the access ID's and lateral branch exit diameter to be optimized, as orienting and locking mechanisms for subsequent whipstocks and deflectors are not required which impose further ID/access restrictions. As the deflector 240 is coupled to or formed integrally as part of the tubular housing 210, the window 220 should appropriately align with the angled surface 250. While not shown, an interior diameter of the cavity 245 may vary along the axial length of the deflector 240.

An interior surface 255 of the deflector 240 includes a downhole latch profile 260 that receives a latch assembly of a running tool, as will be further discussed below. The latch profile 260 and latch assembly may prevent relative rotation between the deflector 240 and the running tool. One or more seals 265 (e.g., three shown) may exist in the deflector 240 for use later in the operational process.

Figure 5:
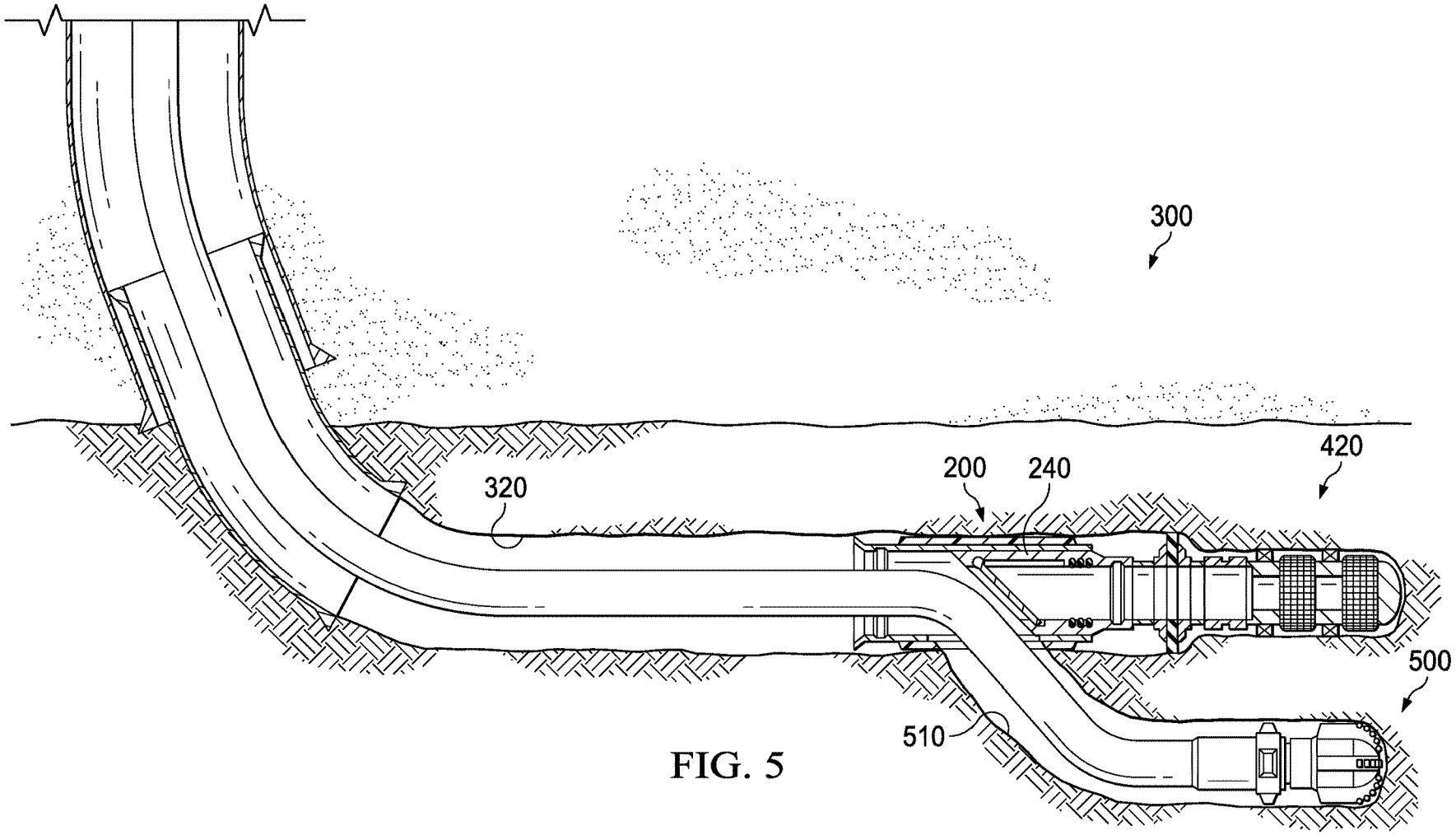

The deflector 240, in one embodiment, may also include a flapper valve 270 that is movable from a cavity open state (as shown) to a cavity closed state (see FIG. 5). The flapper valve 270 may be used to seal the downhole end of the deflector 240 from debris during subsequent drilling processes. The flapper valve 270 would have the additional benefit of providing a fluid loss function, if so required. Those skilled in the art understand that while a flapper valve 270 has been illustrated in FIG. 2, other protection mechanisms might be used and remain within the scope of the disclosure. For example, a dissolvable barrier layer might be used in place of the flapper valve 270. In this embodiment, an acid soluble membrane or similar dissolvable material might be used for the protection mechanism. Alternatively, the protection mechanism could also be a glass plug, or other similar material, which is punctured with the mainbore junction leg on landing A windowed deflector assembly, such as the windowed deflector assembly 200, may have many uses in a well system. In one embodiment, however, the windowed deflector assembly 200 is particularly useful in an open hole well system. That said, the windowed deflector assembly 200 could be used in a cased hole well system as well. Additionally, a windowed deflector assembly according to the disclosure could be used to reduce the number of trips, and therefore time and cost, when creating a multi-lateral junction, for example by including an integral deflection face with sealing arrangement as an integral component of a multi-lateral technology window assembly or throated deflector assembly.

Figure 3:
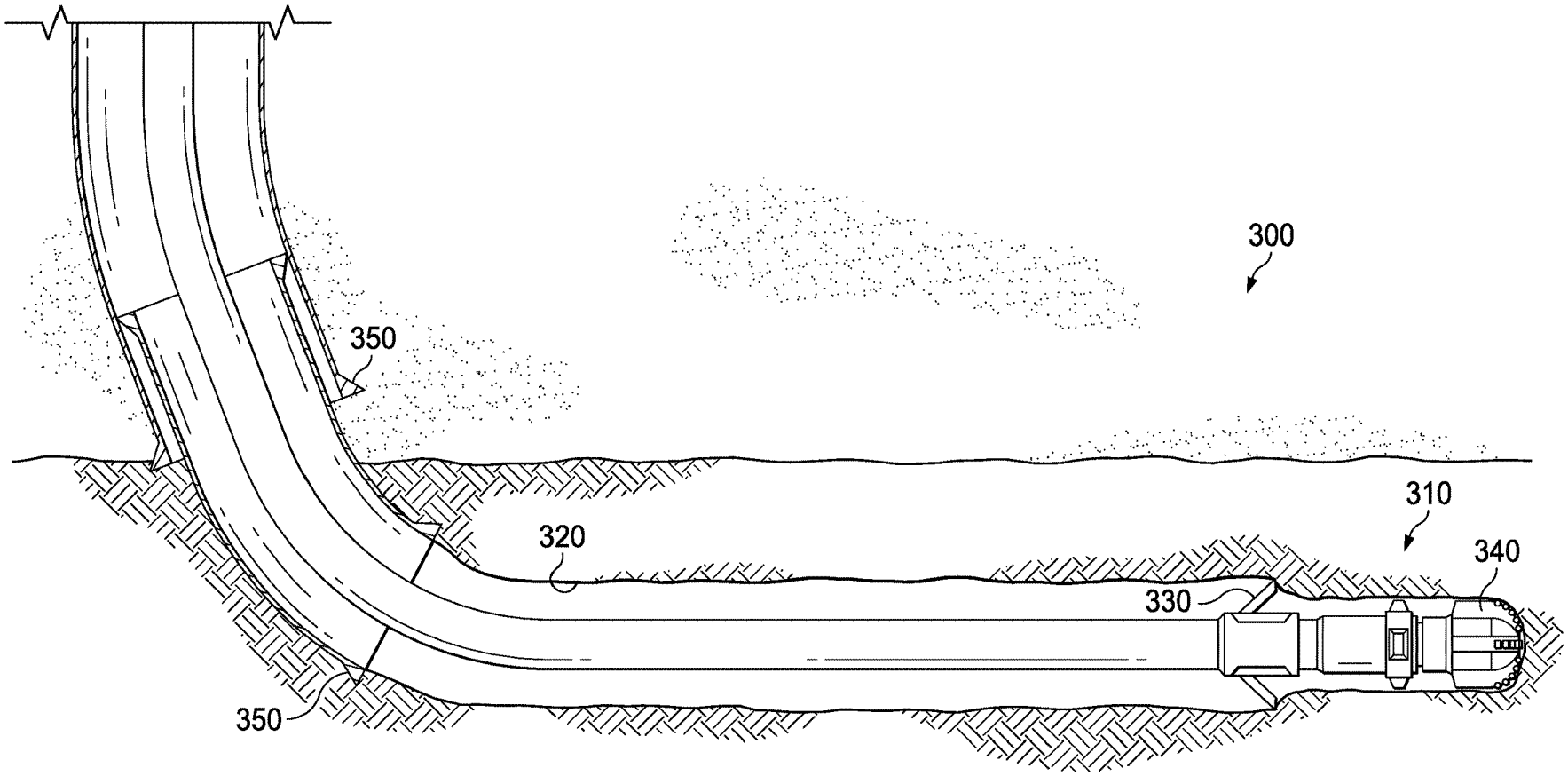
FIGS. 3-9 illustrate the installation and use of the windowed deflector assembly illustrated in FIG. 2 in a well system.

FIGS. 3-9 show the installation and use of the windowed deflector assembly 200 in a well system 300. As previously discussed, the well system 300 may be drilled on-shore or off-shore. As shown in FIG. 3, a drilling assembly 310 is used to drill a main wellbore 320. The drilling assembly 310, in one embodiment, also includes a reamer 330 positioned uphole of the drill bit 340. The reamer 330 increases the diameter of the wellbore 320 that is drilled by the drill bit 340. In some well systems 300, the use of the reamer 330 may not be necessary, and thus the reamer 330 may be omitted from the drilling assembly 310. At this stage, the well system 300 may include multiple casing shoes 350.

Figure 4:
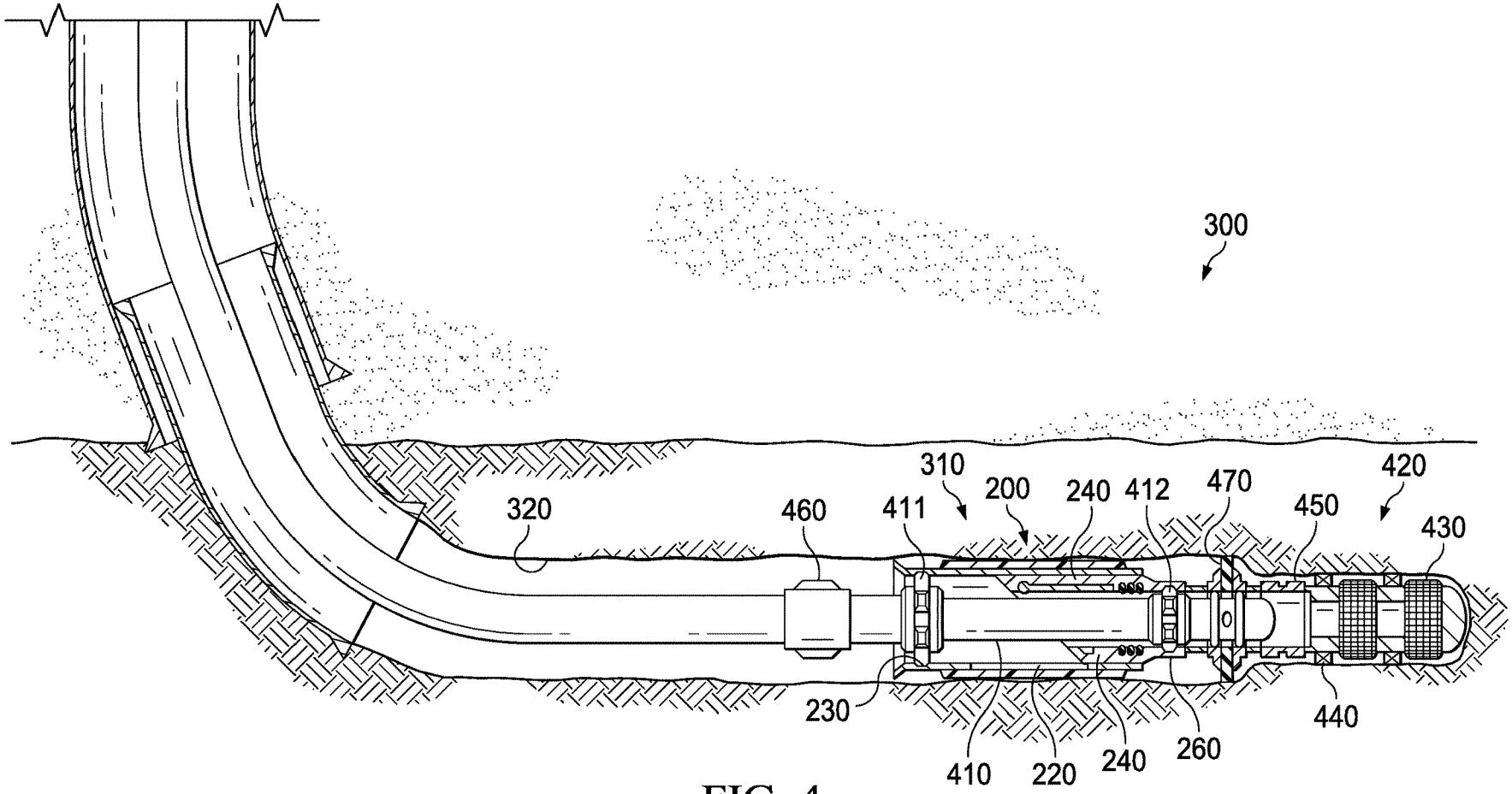

Turning to FIG. 4, after the main wellbore 320 is drilled, a running tool 410, which is attached to the windowed deflector assembly 200 (e.g., that includes the window 220 and deflector 240), is run into the main wellbore 320. The running tool 410 positions the windowed deflector assembly 200, and the mainbore completion 420 (which may in certain embodiments include one or more screens 430 and swell packers 440) in the main wellbore 320, as shown in FIG. 4. The running tool 410 may be coupled to the mainbore completion 420 via a swivel 450 in certain embodiments. The swivel 450, in certain embodiments, may move between a locked state and an unlocked state when necessary. In other embodiments, the running tool 410 may be coupled to the mainbore completion 420 using a threaded connection (not shown), a coupling (not shown), or other similar means known in the art. The running tool 410 may rotate the windowed deflector assembly 200 and the mainbore completion 420 into the desired orientation after the running tool 410 reaches the desired position within the main wellbore 320.

As previously discussed, latch assemblies (e.g., locking keys) 411, 412 on the running tool 410 and latch profiles 230, 260 on the windowed deflector assembly 200 removably couple the running tool 410 to the windowed deflector assembly 200, and additionally prevent relative rotation between the two. In one embodiment, the latch assembly 412 and latch profile 260 provide a majority of the coupling and support. This allows the running tool 410 to rotate the windowed deflector assembly 200 without transferring torque through the wall 215 of the tubular housing 210 having the window 220. Preventing the transfer of torque through the wall 215 of the tubular housing 210 maintains the integrity of the windowed deflector assembly 200 during rotation thereof. In the illustrated embodiment, an measurement while drilling (MWD) tool 460 is used to position and orientate the running tool 410 and the associated components coupled thereto. The MWD tool 460 may additionally be used to position the window 220, for example if it were being used in a low side application as shown in FIG. 4.

Once the windowed deflector assembly 200 and the mainbore completion 420 are positioned and oriented within the main wellbore 320 by the running tool 410, an anchor setting tool 470 (e.g., liner hanger or open hole packer/rock anchor) may be set within the main wellbore 320, for example prior to the running tool 410 being withdrawn from the main wellbore 320. In one example, hydraulics could be used to deploy the anchor setting tool 470. The anchor setting tool 470 maintains the position and orientation the windowed deflector assembly 200 and the mainbore completion 420. The running, positioning, and setting of the windowed deflector assembly 200 and the mainbore completion 420, as described above, may occur in a single trip downhole. However, these operations may also occur in multiple trips downhole. Once the windowed deflector assembly 210 is positioned within the main wellbore 320, and the mainbore completion 420 is set, the running tool 410 decouples from the windowed deflector assembly 210 and mainbore completion 420, and is withdrawn from the main wellbore 320.

As shown in FIG. 5, a drilling assembly 500 passes through the wrap 225 and the window 220 in the tubular housing 210 and proceeds to drill a lateral wellbore 510. In some embodiments, such as the low side application shown, gravity associated with the drilling assembly 500 causes the drilling assembly 500 to pass through the wrap. In other embodiments, drilling assembly 500 deflects off of the angled surfaces 250 of the windowed deflector assembly 210, such as might be the case in high side applications. In some embodiments, the drilling assembly 500 may be used to drill the entire lateral wellbore 510. In other embodiments, the drilling assembly 500 is a dedicated exit bit that is withdrawn from the lateral wellbore 510 after drilling through the wrap 225, the main wellbore 320, and an initial portion of the lateral wellbore 510, and a second conventional drilling assembly is run downhole to complete the drilling of the lateral wellbore 510.

Figure 6:
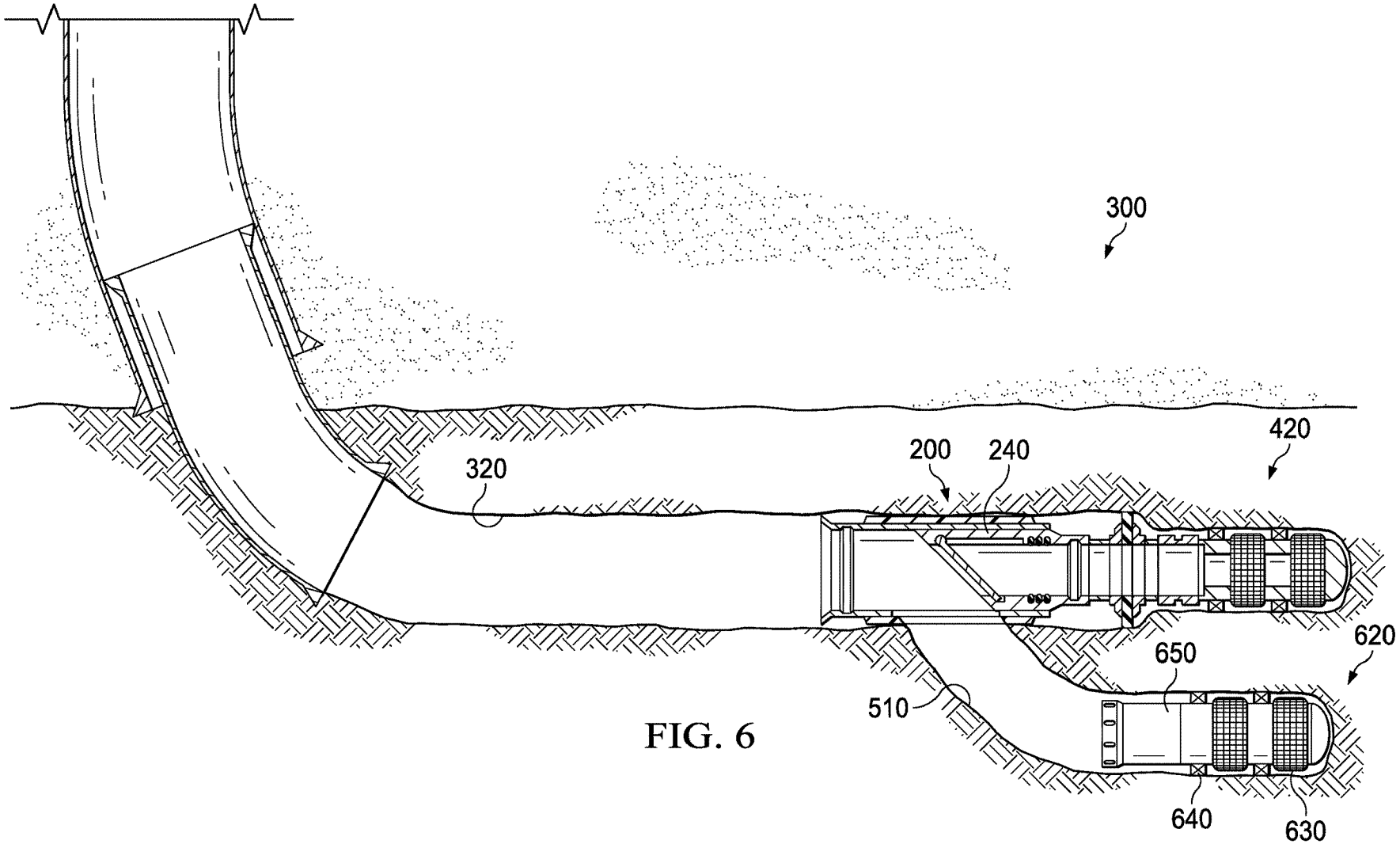

After the lateral wellbore 510 is drilled, the drilling assembly 500 is withdrawn from the lateral wellbore 510 and the main wellbore 320, and a lateral completion 620 is run downhole with a running tool (not shown), such as is shown in FIG. 6. In one embodiment, the running tool includes a retrieving tool (not shown). Similar to the mainbore completion 420, the lateral completion 620, in certain embodiments, includes one or more screens 630 and swell packers 640, as well as a liner top seal bore 650. The swell packers 640, in one embodiment, maintain the position of the lateral completion 620 in the lateral wellbore 510. The lateral completion 620, when deployed, deflects off the windowed deflector assembly 200 and passes through the window 220 into the lateral wellbore 510. Once the lateral completion 620 reaches the desired position within the lateral wellbore 510, as shown in FIG. 6, it is released from the running tool. The lateral completion 620 may be released by pumping fluid downhole to increase an internal pressure of the running tool and actuate a valve assembly (not shown). In another embodiment, an electronic signal may trigger the actuation of the valve assembly.

Figure 7:
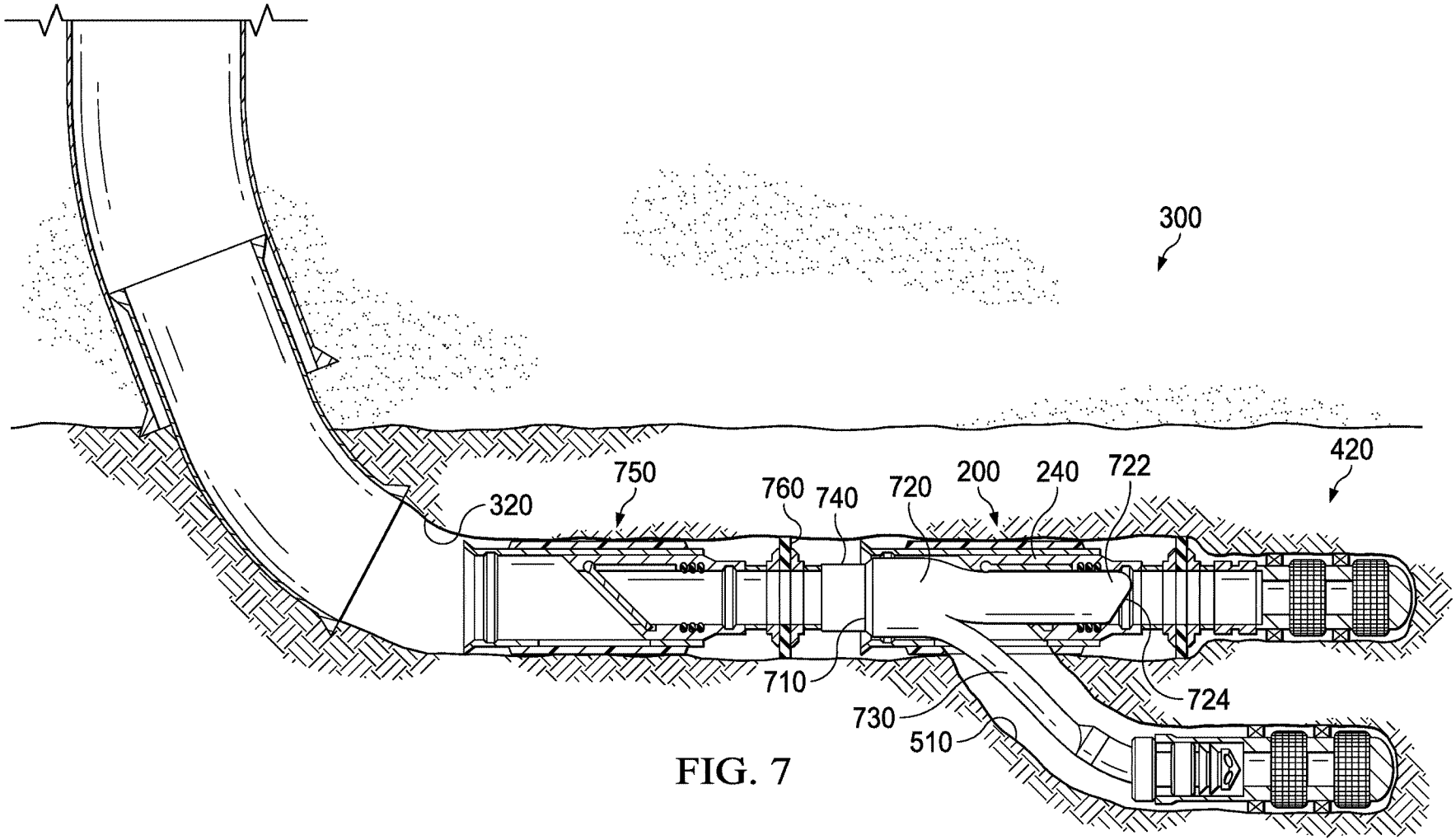

As shown in FIG. 7, a liner junction 710 may be positioned in the main wellbore 320 and the lateral wellbore 510. The liner junction 710, in the embodiment shown, includes a main liner junction leg 720 and a lateral liner junction leg 730. The lateral liner junction leg 730 is typically the first to enter its wellbore, as it is often the longer of the two liner junction legs 720, 730. The lateral liner junction leg 730 typically stings into the liner top seal bore 650, as shown in FIG. 7. The main liner junction leg 720, in the embodiment shown, may include a muleshoe 722 with an angled portion 724. The angled portion 724 on the muleshoe 722 helps the main liner junction leg 720 position itself within the deflector 240. Additionally, the angled portion 724 helps to open the flapper 270. The main liner junction leg 720 seals itself into the mainbore 320 using the seals 265.

In one embodiment, the liner junction 710 is deployed downhole at the same time as a casing alignment sub 740. The casing alignment sub 740, is configured to help align the liner junction 710 (e.g., the main liner junction leg 720 and the lateral liner junction leg 730) appropriately within the main wellbore 320 and the lateral wellbore 510. Additionally, at the same time as the liner junction 710 and casing alignment sub 740 are being deployed, a second window deflector assembly 750 and associated anchor setting tool 760 may be deployed. As one skilled in the art appreciates, a typical running tool (not shown), may be used to deploy these items. Furthermore, in the illustrated embodiment, an MWD (not shown) may be used to position and orientate the running tool and the associated components coupled thereto.

With the liner junction 710 in place, the second anchor setting tool 760 may be hydraulically triggered to fix all the features in place.

The embodiment shown in FIG. 7 is configured as a tri-lateral system, as opposed to a bi-lateral system. Those skilled in the art understand that the principles of the present disclosure are stackable, and thus may be used with any number of laterals within a multi-lateral system. Thus, it is envisioned that any number of lateral wellbores may be drilled using the principles of the present disclosure, and if so, the methodology taught above would be repeated to produce additional laterals.

Figure 8:
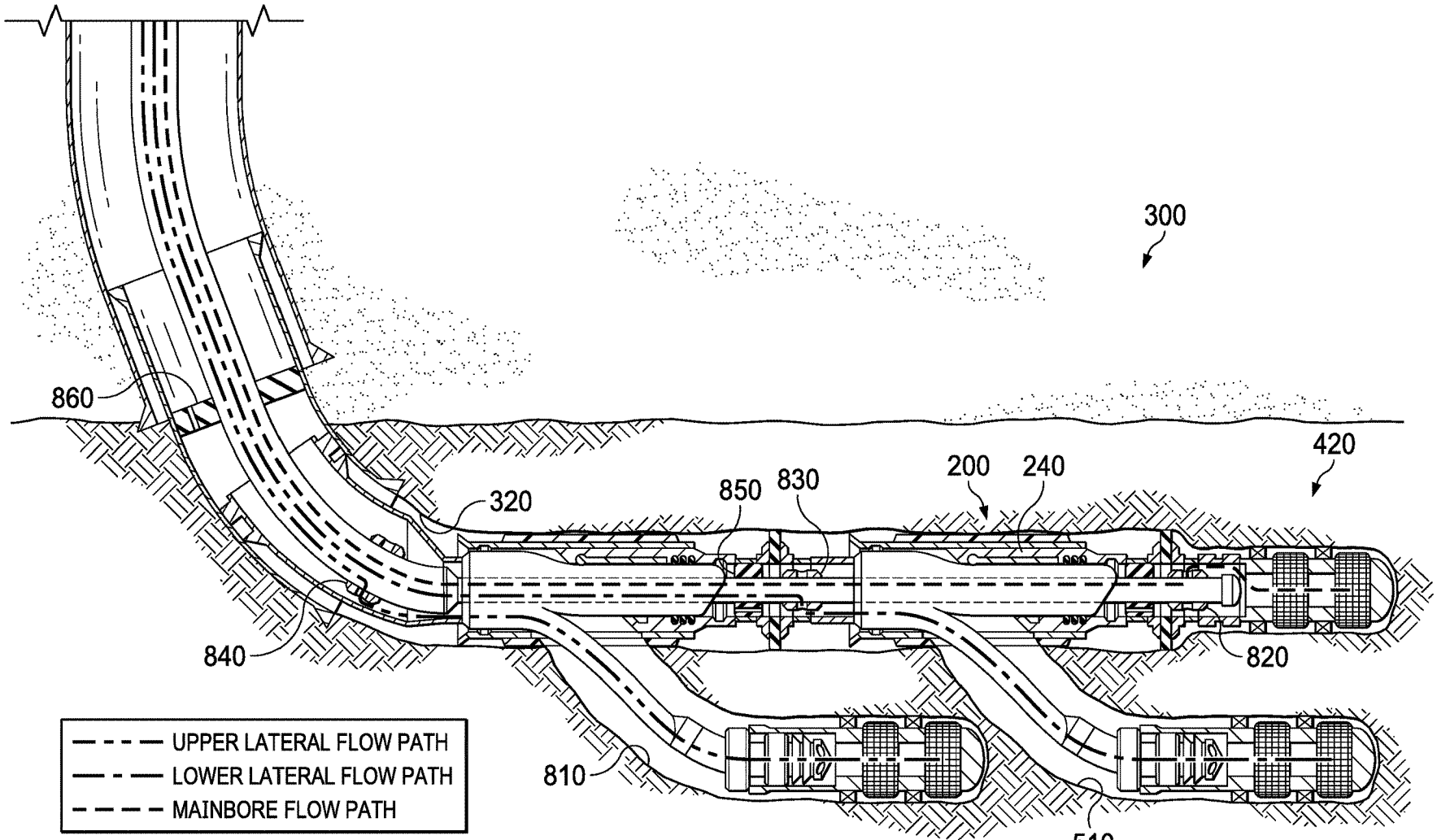

Turning to FIG. 8, illustrated is a completed multi-lateral system. In this multi-lateral system, individual interval control valves (ICVs) 820, 830, 840 may control fluid and/or gas flow from the main wellbore 320, lower lateral wellbore 510, and upper lateral wellbore 810, respectively. The ICVs, 820, 830, 840 may be sliding sleeves, which might be opened and/or closed electronically using a wireline, or alternatively any other known process. Accordingly, the present disclosure should not be limited to any specific ICV. The completed multi-lateral system additionally includes a lower lateral swell/isolation packer 850 and production swell/isolation packer 860, in certain embodiments. Accordingly, each of the main wellbore 320, lower lateral wellbore 510, and upper lateral wellbore 810, are isolated using the swell/isolation packers 850, 860, respectively, and controlled using the ICVs, 820, 830, 840, respectively. Those skilled in the art understand the processes necessary for deploying the swell/isolation packers 850, 860 and the ICVs, 820, 830, 840, including running them downhole after the main wellbore 320, lower lateral wellbore 510, and upper lateral wellbore 810 are substantially completed.

Figure 9:
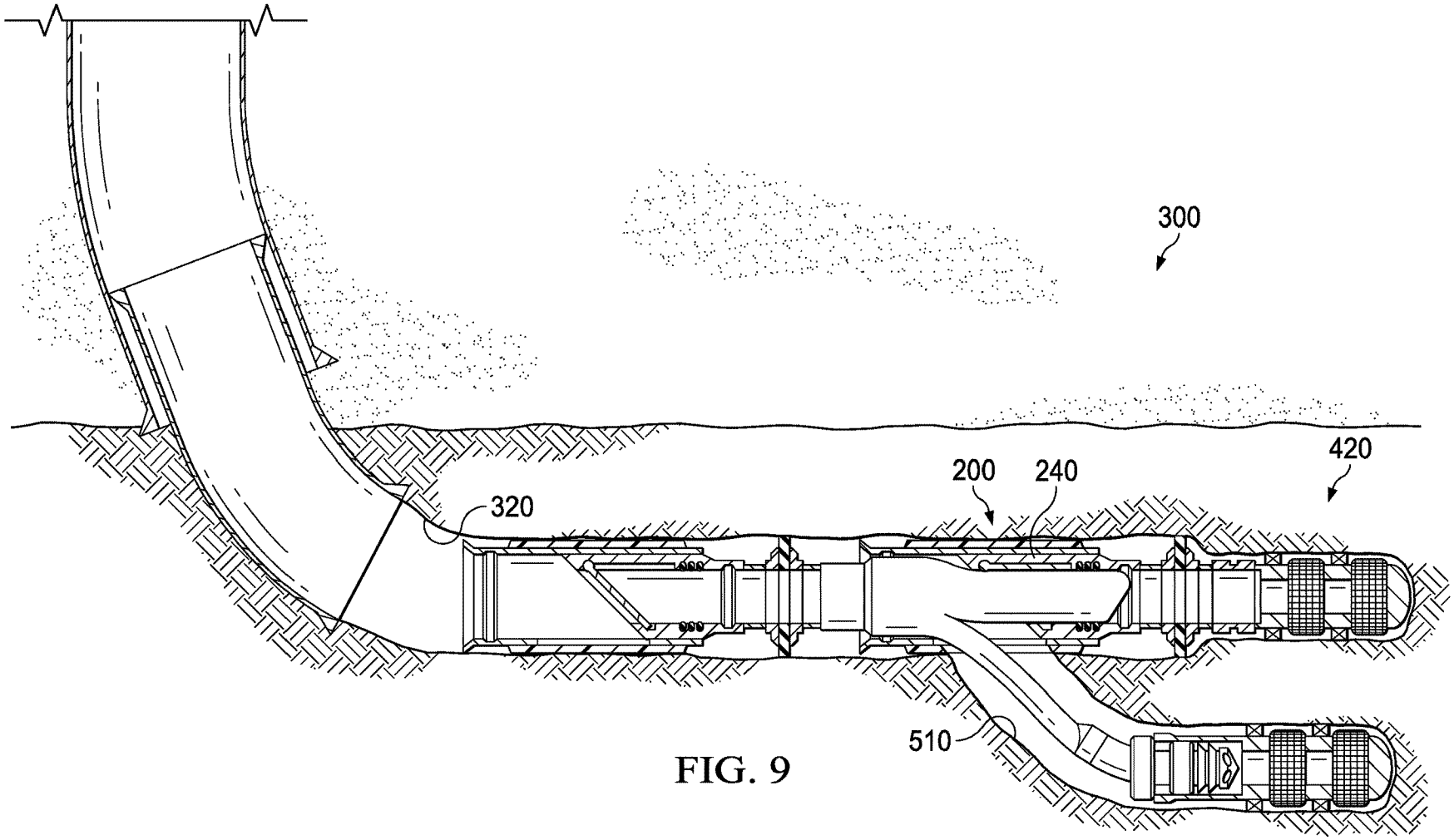

Turning now to FIG. 9, illustrated is a multi-lateral system using smaller features than were used in the multi-lateral system illustrated in FIG. 8. Essentially, what is driving the size of the junction is the size of the last casing shoe. Therefore, the aspects of the present disclosure are scalable.

Although FIGS. 3-9 describe the use of a windowed deflector assembly 200 with relatively complex types of reservoir completions, the windowed deflector assembly 200 is not thereby limited. The windowed deflector assembly 200 may be used with various other types of reservoir completions, such as cemented and perforated production liners, slotted liner completions with or without swell/isolation packers and/or stage cementing, sand control screens with or without swell/isolation packers, open hole gravel pack or frac-pack type completions, and other types of completions known in the art. Thus, while a sand control screen completion has been shown in FIGS. 3-9, it is envisioned that the system could potentially accommodate almost any completion method with some additional operation steps or actions, depending on the specific well/application requirements.

In an alternative embodiment, the windowed deflector assembly could be installed after the mainbore completion on a separate run. For this, a liner top concept similar to the lateral branch could be used to orient, lock and seal the window/deflector into the mainbore liner top. According to this embodiment, the lower mainbore completion could be of any description (e.g., stage cemented/perforated liner, ball drop/sleeve stimulation completion, or pre-perforated or slotted pipe in open hole, among others. In another embodiment, the windowed deflector assembly could have a solid plate covering the window, such that a liner/completion could be run across it. In this embodiment, what is now the lateral liner and whipstock cover plate could be perforated with some orientable perforation guns such as to re-establish hydraulic access to the mainbore for production/injection. Furthermore, the lateral branch completion could be of any type, in the same manner as the mainbore.

Figure 10:
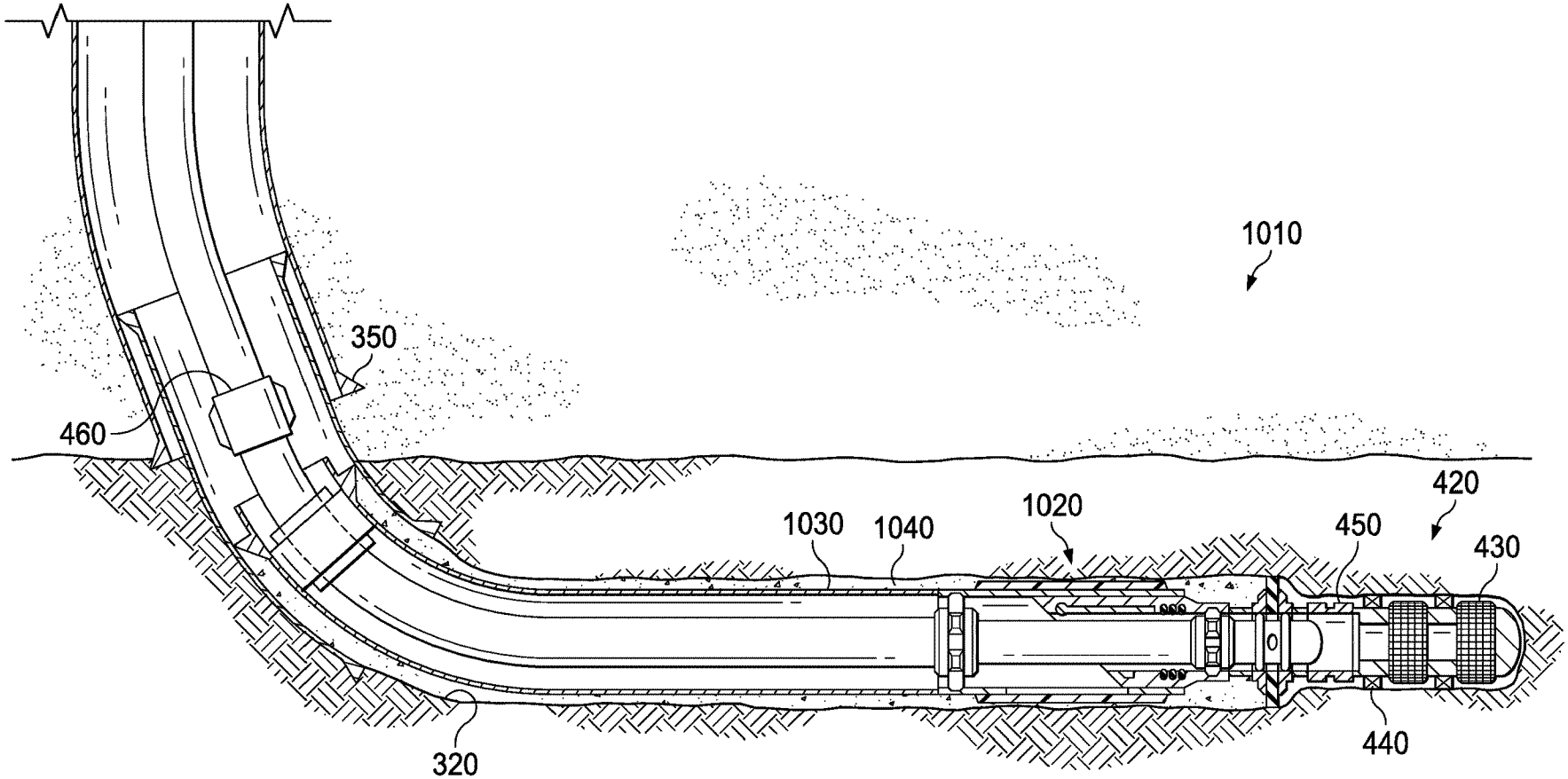
FIGS. 10-11 illustrate an alternative embodiment of the installation and use of a windowed deflector assembly in a well system.
Figure 11:
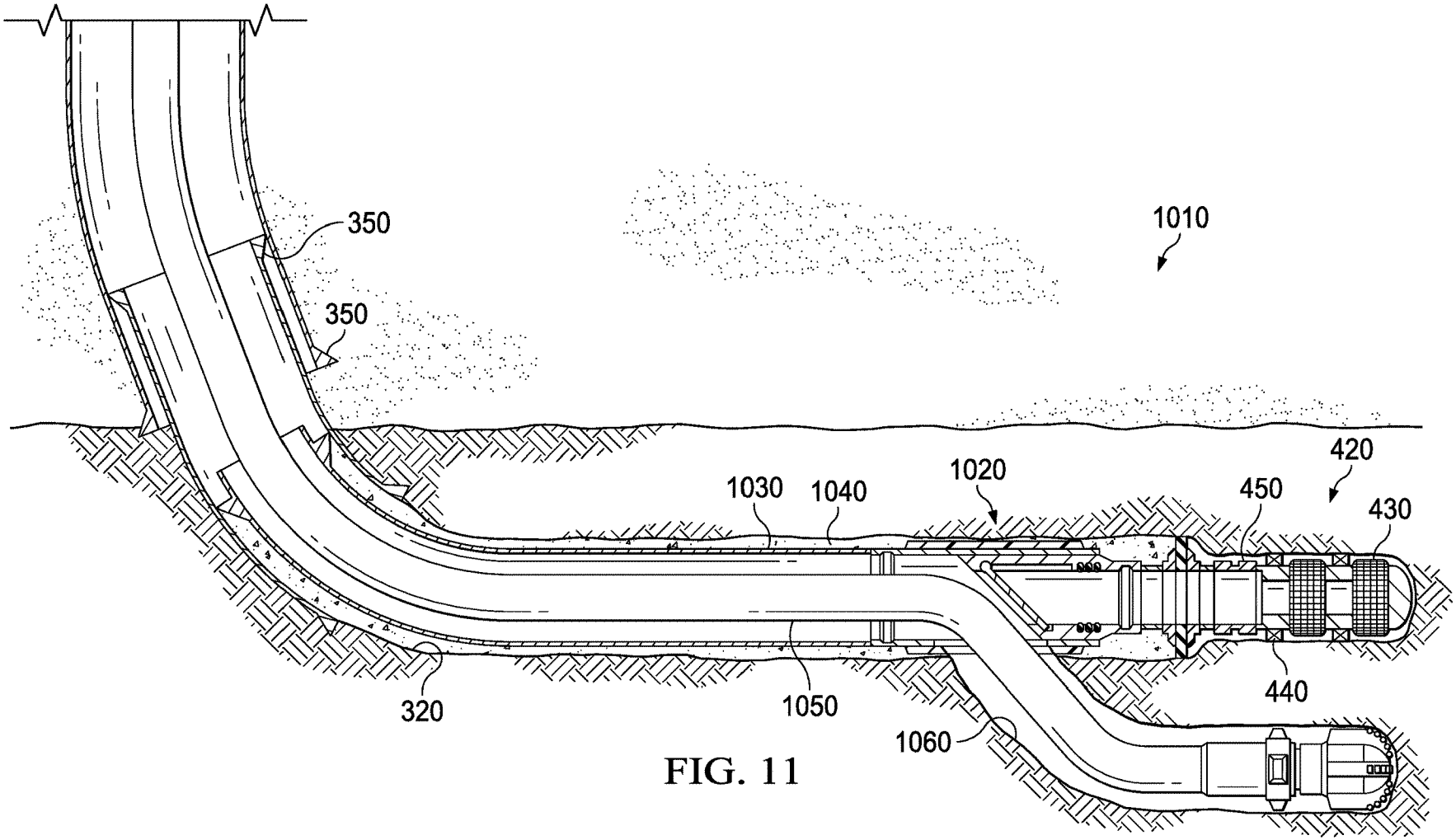

Turning briefly to FIGS. 10-11, illustrated is an alternative embodiment of the installation and use of a windowed deflector assembly 1020 in a well system 1010. The embodiment shown in FIGS. 10-11 is similar in many respects to the embodiment illustrated in FIGS. 4-5 above. Accordingly, like reference numbers have been used to illustrate similar, if not identical, features. The embodiment shown in FIGS. 10-11 differs, however, in that the windowed deflector assembly 1020 is run downhole on a liner 1030, and subsequent thereto the liner 1030 and windowed deflector assembly 1020 are cemented 1040 into place in the main wellbore 320. As shown in FIG. 11, a drilling assembly 1050 may then drill through the wrap of the windowed deflector assembly 1020, and the cement 1040 in this embodiment, thereby forming the lateral wellbore 1060.

Aspects disclosed herein include:

A. A windowed deflector assembly, the windowed deflector assembly including: 1) a tubular housing, the tubular housing having a window there through; 2) a wrap covering the window; and 3) a deflector coupled to or formed integrally as part of the tubular housing.

B. A well system, the well system including: A) a main wellbore extending through one or more subterranean formations; B) a lateral wellbore extending from the main wellbore; C) a windowed deflector assembly located at a junction between the main wellbore and the lateral wellbore, the windowed deflector assembly including: 1) a tubular housing, the tubular housing having a window there through; 2) a wrap covering at least a portion of the window, wherein the tubular housing comprises a first material having a first yield strength, and the wrap comprises a second material having a second lesser yield strength; and 3) a deflector coupled to or formed integrally as part of the tubular housing.

C. A method for forming a well system, the method including: A) forming a main wellbore through one or more subterranean formations; B) positioning a windowed deflector assembly at a desired lateral junction location in the main wellbore, the windowed deflector assembly including: 1) a tubular housing, the tubular housing having a window there through; 2) a wrap covering at least a portion of the window, wherein the tubular housing comprises steel having a first yield strength, and the wrap comprises a material having a second lesser yield strength; and 3) a deflector coupled to or formed integrally as part of the tubular housing; and C) forming a lateral wellbore off of the main wellbore, including drilling through the wrap covering at least a portion of the window and into the subterranean formation.

Aspects A, B, and C may have one or more of the following additional elements in combination: Element 1: wherein the wrap comprises a non-ferromagnetic material. Element 2: wherein the wrap comprises aluminum or an alloy thereof. Element 3: wherein the wrap comprises reinforced plastic, fiberglass, a composite, or carbon fiber. Element 4: wherein the wrap has a yield strength of 30 ksi or less. Element 5: wherein the wrap has a yield strength of 10 ksi or less. Element 6: wherein the wrap has a yield strength ranging from 5 ksi to 18 ksi. Element 7: wherein the tubular housing comprises steel having a first yield strength, and the wrap comprises a material having a second lesser yield strength. Element 8: wherein the wrap is a tubular wrap that extends entirely around the tubular housing to cover the window. Element 9: wherein the wrap covers the window but does not extend entirely around the tubular housing. Element 10: further including an uphole locking profile located in an interior surface of the tubular housing. Element 11: wherein the deflector includes a downhole angled surface. Element 12: wherein the window is located in a wall of the tubular housing opposite the downhole angled surface. Element 13: further including a downhole latch profile located in an interior surface of the deflector. Element 14: wherein the deflector includes a cavity that extends through an axial length thereof, and further including a protection mechanism for opening and closing the cavity. Element 15: wherein the protection mechanism is a flapper valve extending from the deflector and movable between a cavity open state and a cavity closed state. Element 16: further including one or more seals located along an inner surface of the deflector. Element 17: wherein the deflector is rotationally fixed relative to the tubular housing and the window.

Those skilled in the art to which this application relates will appreciate that other and further additions, deletions, substitutions and modifications may be made to the described embodiments.

What is claimed is:

1. A windowed deflector assembly, comprising:

a tubular housing, the tubular housing having a window there through and an uphole profile located in an interior surface thereof;

a wrap covering the window; and a deflector coupled to or formed integrally as part of the tubular housing, the deflector having;

a cavity that extends through an axial length thereof;

a downhole angled surface;

a downhole latch profile located in an interior surface of the deflector downhole of the downhole angled surface; and a protection mechanism positioned between the downhole angled surface and the downhole latch profile for opening and closing the cavity, wherein at least a portion of the protection mechanism is radially aligned with the window.

2. The windowed deflector assembly of claim 1, wherein the wrap comprises a non-ferromagnetic material.

3. The windowed deflector assembly of claim 1, wherein the wrap comprises aluminum or an alloy thereof.

4. The windowed deflector assembly of claim 1, wherein the wrap comprises reinforced plastic, fiberglass, a composite, or carbon fiber.

5. The windowed deflector assembly of claim 1, wherein the wrap has a yield strength of 30 ksi or less.

6. The windowed deflector assembly of claim 1, wherein the wrap has a yield strength of 10 ksi or less.

7. The windowed deflector assembly of claim 1, wherein the wrap has a yield strength ranging from 5 ksi to 18 ksi.

8. The windowed deflector assembly of claim 1, wherein the tubular housing comprises steel having a first yield strength, and the wrap comprises a material having a second lesser yield strength.

9. The windowed deflector assembly of claim 1, wherein the wrap is a tubular wrap that extends entirely around the tubular housing to cover the window.

10. The windowed deflector assembly of claim 1, wherein the wrap covers the window but does not extend entirely around the tubular housing.

11. The windowed deflector assembly of claim 1, wherein the window is located in a wall of the tubular housing opposite the downhole angled surface.

12. The windowed deflector assembly of claim 1, further including one or more seals located along an inner surface of the deflector.

13. The windowed deflector assembly of claim 1, wherein the deflector is rotationally fixed relative to the tubular housing and the window.

14. The windowed deflector assembly of claim 1, wherein the protection member is configured to align with the downhole angled surface when closing the cavity.

15. A well system, comprising:

a main wellbore extending through one or more subterranean formations;

a lateral wellbore extending from the main wellbore;

a windowed deflector assembly located at a junction between the main wellbore and the lateral wellbore, the windowed deflector assembly including:

a tubular housing, the tubular housing having a window there through;

a wrap covering at least a portion of the window, wherein the tubular housing comprises a first material having a first yield strength, and the wrap comprises a second material having a second lesser yield strength; and a deflector coupled to or formed integrally as part of the tubular housing, the deflector having;

a cavity that extends through an axial length thereof;

a downhole angled surface; and a protection mechanism positioned between the downhole angled surface and the downhole latch profile for opening and closing the cavity, wherein at least a portion of the protection mechanism is radially aligned with the window.

16. A method for forming a well system, comprising:

forming a main wellbore through one or more subterranean formations;

positioning a windowed deflector assembly at a desired lateral junction location in the main wellbore, the windowed deflector assembly including:

a tubular housing, the tubular housing having a window there through;

a wrap covering at least a portion of the window, wherein the tubular housing comprises steel having a first yield strength, and the wrap comprises a material having a second lesser yield strength; and a deflector coupled to or formed integrally as part of the tubular housing; and forming a lateral wellbore off of the main wellbore, including drilling through the wrap covering at least a portion of the window and into the subterranean formation.

* * * * *